US007362203B2

(12) United States Patent
Posamentier

(10) Patent No.: US 7,362,203 B2
(45) Date of Patent: Apr. 22, 2008

(54) MULTI-TAP MICROELECTROMECHANICAL INDUCTOR

(75) Inventor: Joshua D. Posamentier, Oakland, CA (US)

(73) Assignee: Intel Corporation, Santa Clara, CA (US)

( * ) Notice: Subject to any disclaimer, the term of this patent is extended or adjusted under 35 U.S.C. 154(b) by 340 days.

(21) Appl. No.: 11/137,748

(22) Filed: May 24, 2005

(65) Prior Publication Data

US 2006/0267717 A1 Nov. 30, 2006

(51) Int. Cl.
*H01F 29/02* (2006.01)

(52) U.S. Cl. ..... 336/137; 336/144; 336/150

(58) Field of Classification Search ..... 336/137–150
See application file for complete search history.

(56) References Cited

U.S. PATENT DOCUMENTS 5,057,809 A * 10/1991 Chandler et al. ..... 336/144

* cited by examiner

*Primary Examiner*—Ramon M. Barrera
(74) *Attorney, Agent, or Firm*—Kacvinsky LLC

(57) ABSTRACT

An apparatus, system, method, and article for a multi-tap microelectromechanical inductor are described. The apparatus may include an inductor formed on a substrate, a switching mechanism contacting the inductor to vary inductance of said inductor; and a disconnect mechanism contacting the inductor to reduce parasitic effects of the inductor upon actuation of said switching mechanism. Other embodiments are described and claimed.

15 Claims, 6 Drawing Sheets

MULTI-TAP MICROELECTROMECHANICAL INDUCTOR

BACKGROUND

Inductors have many applications in wireless communications systems such as radio frequency (RF) systems, cellular communications systems, and wireless networks. For example, an inductor may form part of the front-end circuitry of a wireless device such as an integrated circuit (IC) of an R-F transceiver.

Microelectromechanical systems (MEMS) technology integrates microelectronics with various mechanical and electromechanical elements (e.g., sensors, actuators) on a substrate. MEMS technology may be utilized to reduce the size of front-end circuitry in a wireless device by fabricating systems with components having dimensions of only a few microns.

DETAILED DESCRIPTION

Figure 1:
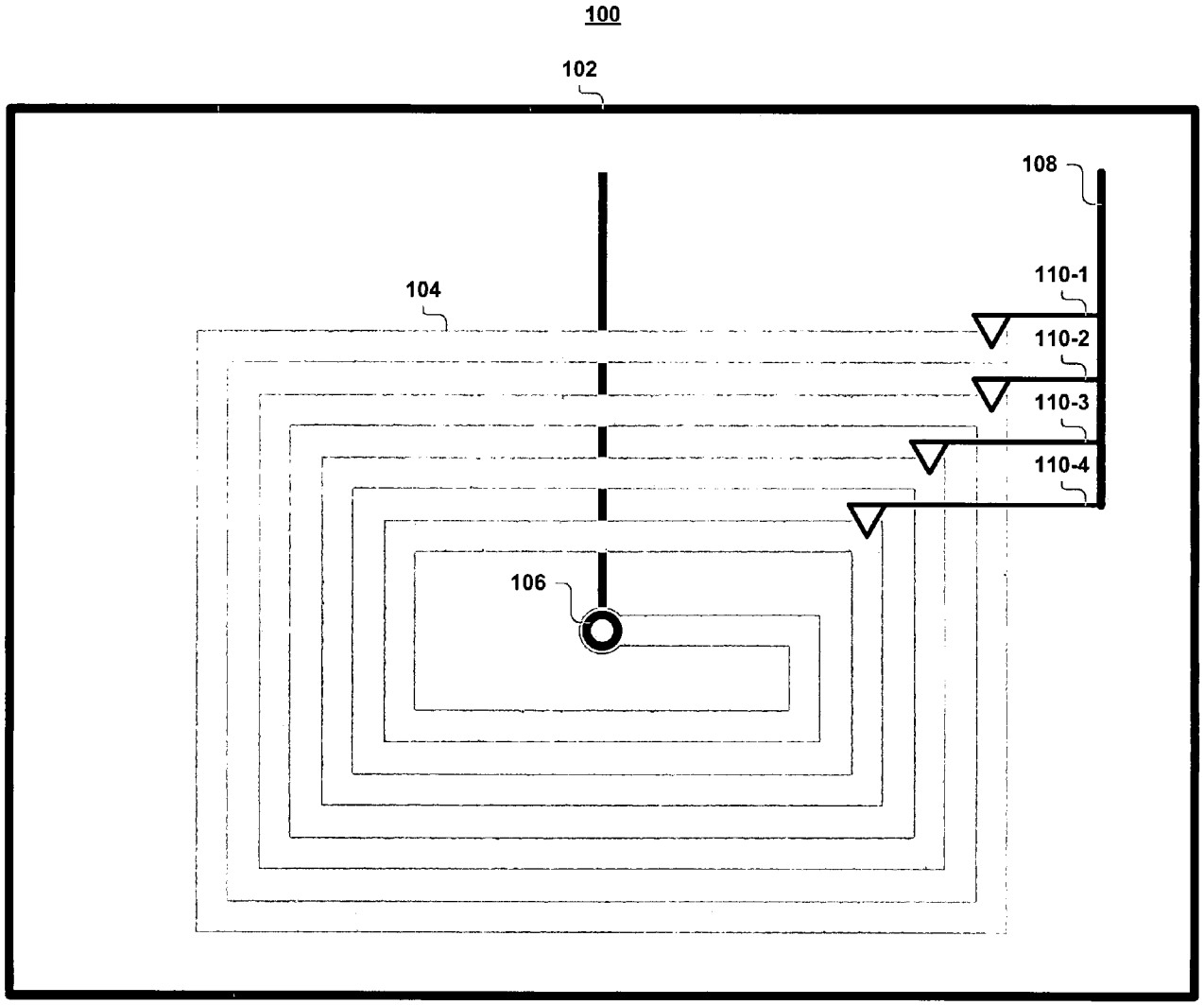
FIG. 1 illustrates one embodiment of a node.

FIG. 1 illustrates one embodiment of a node. FIG. 1 illustrates a MEMS node 100. In various embodiments, the MEMS node 100 may comprise a substrate 102 and one or more microelectronic, mechanical, and/or electromechanical elements fabricated on the substrate 102. The substrate 102 may comprise a substrate material such as silicon or gallium arsenide (GaAs), for example. In various implementations, microelectronics may be fabricated on the substrate 102 using silicon-based IC processes such as bipolar, complementary metal oxide semiconductor (CMOS), and bipolar CMOS (BiCMOS) processes, for example. Mechanical and electromechanical elements may be fabricated using micromachining techniques for etching and/or adding structural layers to the substrate 102. For example, mechanical and electromechanical elements may be fabricated on the substrate 102 by depositing thin films of material on the substrate 102, patterning a mask on top of the films using photolithographic imaging, and etching the films to the mask. The embodiments are not limited in this context.

The MEMS node 100 may comprise an inductor 104. The inductor 104 may comprise a metal material such as copper (Cu) or aluminum (Al) and/or a metal alloy, for example. In one embodiment, the inductor 104 may comprise a single layer of metal arranged on the substrate 102 in a concentric rectangular configuration. In other embodiments, the inductor 104 may have other configurations such as square, circular, or octagonal, for example. In some implementations, the inductor 104 may be disposed on multiple layers of the substrate 102 in a helical configuration, for example. The embodiments are not limited in this context.

The MEM node 100 may comprise conductive via 106. The conductive via 106 may comprise a metal material such as Cu, Al, and/or a metal alloy, for example, and may contact the inductor 104 through a dielectric layer. In various embodiments, the conductive via 106 may be connected to one or more microelectronic, mechanical, and/or electromechanical elements fabricated on the substrate 102. The embodiments are not limited in this context.

The MEMS node 100 may comprise a switching element 108 arranged to provide the MEMS node 100 with a tunable inductor. In various embodiments, the switching mechanism 108 may be accessible from the top of the substrate 102 and may comprise multiple taps to contact the inductor 104. In one embodiment, for example, the switching element 108 may comprise several MEMS switch armatures 110-1-4 arranged to make contact with the inductor 104 in various locations. Each of the MEMS switch armatures 110-1-4 may comprise a metal material such as Al, Cu, gold (Au), and/or nickel (Ni), for example, having a thickness of about one micron and an air gap of one or two microns. Although a limited number of MEMS switch armatures are shown by way of example, it can be appreciated that more or less MEMS switch armatures may be used. The embodiments are not limited in this context.

In one embodiment, the MEMS switch armatures 110-1-4 may comprise normally open cantilever-type MEMS switches. For example, the MEMS switch armatures 110-1-4 may comprise fairly quick low-resistance contacts that close when actuated. In other embodiments, the MEMS switch armatures 110-1-4 may comprise bridge-type MEMS switches. The embodiments are not limited in this context.

The MEMS switch armatures 110-1-4 may be actuated by various actuation mechanisms such as a thermostatic or electrostatic mechanism, for example. In various embodiments, the switching mechanism 108 may be connected to control lines for actuating the MEMS switch armatures 110-1-4. The control lines may comprise voltage lines connected to a multiplexer arranged to apply voltage to one of the MEMS switch armatures 104-1-4 at a time. In various implementations, each of the MEMS switch armatures 104-1-4 may be independently controlled by a control line actuated by a thermal or electrostatic mechanism. The embodiments are not limited in this context.

In various implementations, actuating one of the MEMS switch armatures 110-1-4 may increase or decreases the inductance of the inductor 104. For example, when the first MEMS switch armature 110-1 is actuated and closed, the inductance of the inductor 104 is based on the distance from the center of the inductor 104 to the point at which the MEMS switch armature 110-1 contacts the inductor 104. Similarly, when the second MEMS switch armature 110-2, the third MEMS switch armature 110-3, or the fourth MEMS switch armature 110-4 is actuated, the inductance of the inductor 104 is based on the distance from the center of the inductor 104 to the contact point of the second MEMS switch armature 110-2, the third MEMS switch armature 110-3, or the fourth MEMS switch armature 110-4, respectively. Individually actuating one of the MEMS switch armatures 110-1-4 may vary the number of turns of the inductor 104, which in turn varies the inductance of the inductor 104. The embodiments are not limited in this context.

Figure 2:
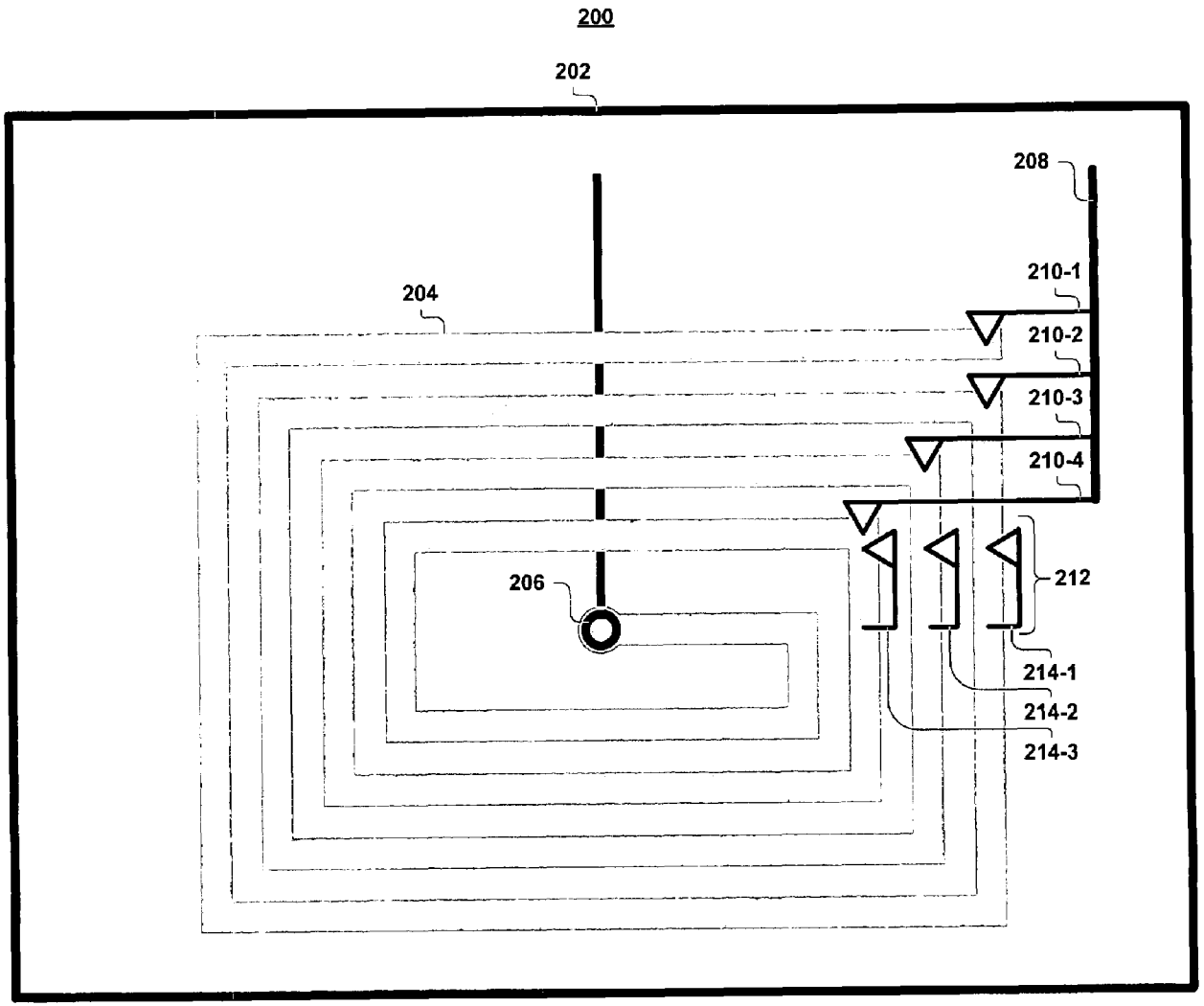
FIG. 2 illustrates one embodiment of a node.

FIG. 2 illustrates one embodiment of a node. FIG. 2 illustrates a MEMS node 200. In various embodiments, the MEMS node 200 may comprise a substrate 202 and one or more microelectronic, mechanical, and/or electromechanical elements fabricated on the substrate 202. As shown, the MEMS node 200 may comprise an inductor 204, a conductive via 206, and a switching mechanism 208 comprising several MEMS switch armatures 210-1-4 fabricated on the substrate 202.

As shown, the MEMS node 200 may further comprise a disconnect mechanism 212. In various implementations, the disconnect mechanism 212 may be arranged to break the continuity of the inductor 204 after actuation of one of the MEMS switch armatures 210-1-4 to reduce parasitic effects of any remaining stub formed after the MEMS contact. The disconnect mechanism 212 may prevent the unused or unterminated portion of the inductor 204 after each tap from acting like an RF stub by emitting unintentional radiation or by adding unintentional capacitive loading.

In various embodiments, the disconnect mechanism 212 may comprise several MEMS disconnect switches 214-1-3 arranged to disconnect a portion of the inductor 204 after MEMS switch armatures 210-1-4. Each of the MEMS disconnect switches 214-1-3 may comprise a cantilever-type or bridge-type MEMS switch having a fairly quick low-resistance contact that closes when actuated. While the MEMS disconnect switches 214-1-3 may be shown as having a particular arrangement by way of example, it can be appreciated that the MEMS disconnect switches 214-1-3 may be arranged in various other ways. The embodiments are not limited in this context.

In various implementations, actuating one of the MEMS switch armatures 210-1-4 may increase or decreases the inductance of the inductor 204. For example, when the first MEMS switch armature 210-1 is actuated and closed, the inductance of the inductor 204 is based on the distance from the center of the inductor 204 to the point at which the MEMS switch armature 210-1 contacts the inductor 204. In this case, the MEMS disconnect switches 214-1-3 are not actuated and may remain open.

When the second MEMS switch armature 210-2 is actuated, the inductance of the inductor 204 is based on the distance from the center of the inductor 204 to the contact point of the second MEMS switch armature 210-2. In this case, the first MEMS disconnect switch 214-1 may be actuated and closed to reduce the parasitic effects of the inductor 204 after the second MEM switch armature 210-2. When the third MEMS switch armature 210-3 is actuated, the second MEMS disconnect switch 214-2 may be actuated and closed to reduce the parasitic effects of the inductor 204 after the third MEMS switch armature 210-3. When the fourth MEMS switch armature 210-4 is actuated, the third MEMS disconnect switch 214-3 may be actuated and closed to reduce the parasitic effects of the inductor 204 after the fourth MEMS switch armature 210-4. The embodiments are not limited in this context.

Figure 3:
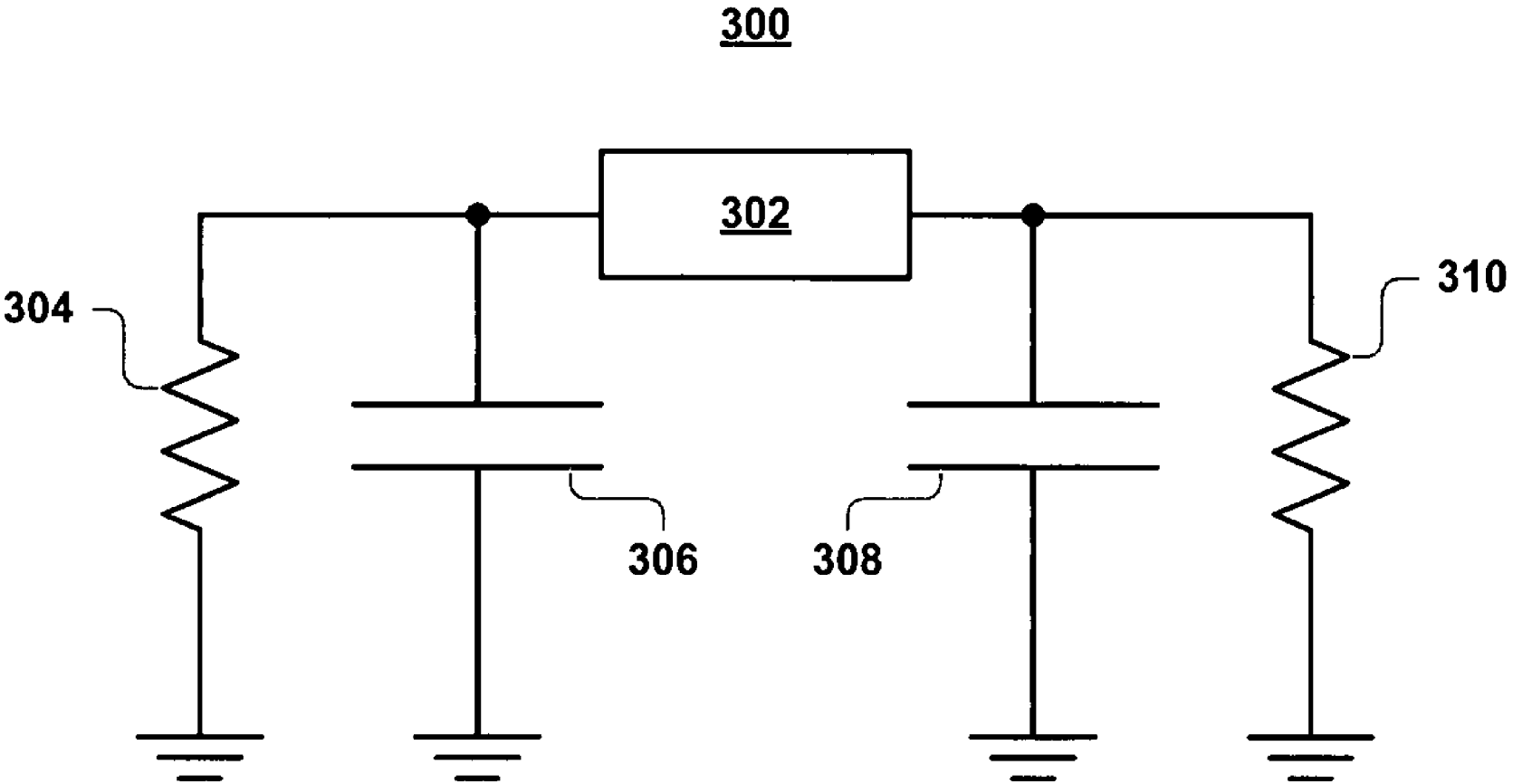
FIG. 3 illustrates one embodiment of a system.

FIG. 3 illustrates one embodiment of a system. FIG. 3 illustrates a block diagram of an impedance matching system 300. In various embodiments, the impedance matching system 300 may be arranged to mitigate impedance mismatch at an RF port of a wireless communications system, for example. In general, impedance mismatch among components of a wireless communications system such as a radio frequency (RF) system may cause signal power loss and result in poor transmission and/or reception. For example, an antenna with high impedance mismatch and a poor voltage standing wave ratio (VSWR) may experience significant reflected power when subjected to interference and greatly increase the demands on the front-end circuitry of a wireless device.

In various embodiments, the impedance matching system 300 may comprise a tunable MEMS inductor node 302 to dynamically tune the impedance matching system 300. The tunable inductor node 302 may be implemented by MEMS node 100 or MEMS node 200, for example. The embodiments are not limited in this context.

In one embodiment, the impedance matching system 300 may comprise a tunable MEMS inductor node 302 connected to a first resistor 304, a first capacitor 306, a second capacitor 308, and a second resistor 310. In such an embodiment, the impedance matching system 300 may be implemented as a PI network. For RF impedance matching, a PI network allows independent correction for inductive mismatch or capacitive mismatch. The embodiments are not limited in this context.

Figure 4:
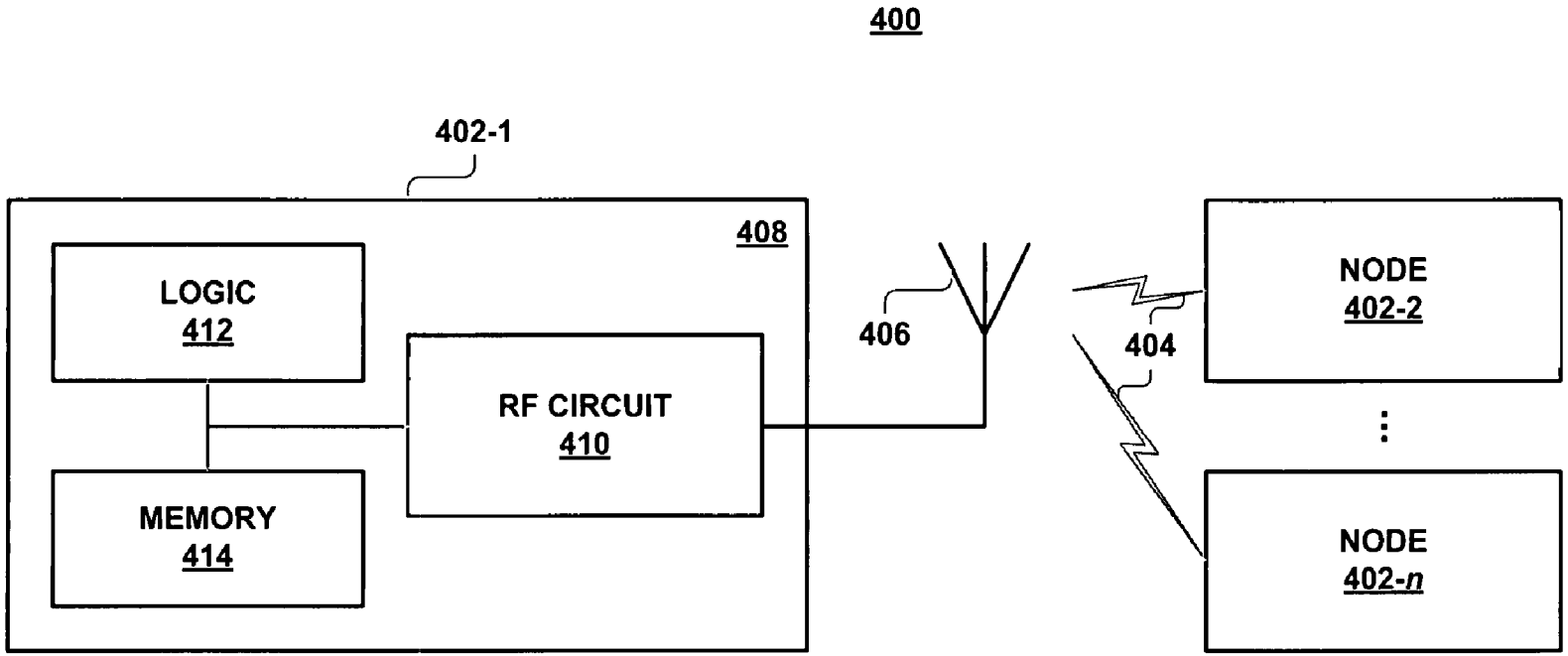
FIG. 4 illustrates one embodiment of system.

FIG. 4 illustrates one embodiment of a system. FIG. 4 illustrates a block diagram of a communications system 400. The communications system 400 may comprise multiple nodes, such as nodes 402-1 to 402-n, where n represents any positive integer. A node generally may comprise any physical or logical entity for communicating information in the system 400 and may be implemented as hardware, software, or any combination thereof, as desired for a given set of design parameters or performance constraints. Although FIG. 4 may show a limited number of nodes by way of example, it can be appreciated that more or less nodes may be employed for a given implementation.

In various embodiments, a node may comprise, or be implemented as, a computer system, a computer sub-system, a computer, an appliance, a workstation, a terminal, a server, a personal computer (PC), a laptop, an ultra-laptop, a handheld computer, a personal digital assistant (PDA), a set top box (STB), a telephone, a mobile telephone, a cellular telephone, a handset, a wireless access point, a base station, a radio network controller (RNC), a mobile subscriber center (MSC), a microprocessor, an integrated circuit such as an application specific integrated circuit (ASIC), a programmable logic device (PLD), a processor such as general purpose processor, a digital signal processor (DSP) and/or a network processor, an interface, an input/output (I/O) device (e.g., keyboard, mouse, display, printer), a router, a hub, a gateway, a bridge, a switch, a circuit, a logic gate, a register, a semiconductor device, a chip, a transistor, or any other device, machine, tool, equipment, component, or combination thereof. The embodiments are not limited in this context.

In various embodiments, a node may comprise, or be implemented as, software, a software module, an application, a program, a subroutine, an instruction set, computing code, words, values, symbols or combination thereof. A node may be implemented according to a predefined computer language, manner or syntax, for instructing a processor to perform a certain function. Examples of a computer language may include C, C++, Java, BASIC, Perl, Matlab, Pascal, Visual BASIC, assembly language, machine code, micro-code for a network processor, and so forth. The embodiments are not limited in this context.

In various embodiments, the communications system 400 may be implemented as a wireless communications system arranged to communicate information over one or more types of wireless communication media 404. An example of wireless communication media 404 may include portions of a wireless spectrum, such as the RF spectrum. In such embodiments, the nodes 402-1-n may include components and interfaces suitable for communicating information signals over wireless communication media 404. Such components and interfaces may include, for example, one or more antennas, wireless transmitters/receivers ("transceivers"), amplifiers, filters, control logic, and so forth. As used herein, the term "transceiver" may be used in a very general sense to include a transmitter, a receiver, or a combination of both. While the nodes 402-1-n may be illustrated and described as comprising several separate functional elements, it can be appreciated that a greater or lesser number of functional elements may be used. The embodiments are not limited in this context.

In various embodiments, the communications system 400 may comprise a wireless node 402-1. The wireless node 402-1 may comprise an antenna 406 connected to an integrated circuit (IC) 408. The antenna 406 may comprise, for example, an internal antenna, an omni-directional antenna, a monopole antenna, a dipole antenna, a lead-frame antenna, an end-fed antenna, a linear polarized antenna, a circular polarized antenna, a patch antenna, a plane-inverted F antenna, a micro-strip antenna, a diversity antenna, a dual antenna, an antenna array, a helical antenna, and so forth. The embodiments are not limited in this context.

In various embodiments, the IC 408 may comprise a semiconductor IC. The IC 408 may comprise an RF circuit 410, logic 412, and memory 414. The RF circuit 410 may comprise, for example, RF transmitter and receiver portions, each comprising a collection of discrete components. Logic 412 may comprise, for example, a processor, controller, state machine, programmable logic array, and the like, and may operate under the control of program instructions. Memory 414 may comprise, for example, program memory, data memory or any combination thereof. Memory also may comprise, for example, read-only memory (ROM), random-access memory (RAM), static RAM (SRAM) dynamic RAM (DRAM), Double-Data-Rate DRAM (DDRAM), synchronous DRAM (SDRAM), programmable ROM (PROM), erasable programmable ROM (EPROM), electrically erasable programmable ROM (EEPROM), flash memory, or any other type of media suitable for storing information. The embodiments are not limited in this context.

In various implementations, the wireless node 402-1 may comprise front-end circuitry implemented using a tunable inductor. For example, the RF circuit 410 may comprise a MEMS node such as MEMS node 100 or MEMS node 200 to implement a tunable inductor. In various embodiments, the RF circuit 410 may comprise a tunable impedance matching system having a tunable inductor, such as impedance matching system 300, to mitigate impedance mismatch at the wireless node 402-1. The embodiments are not limited in this context.

In various implementations, the wireless node 402-1 may comprise an RFID transceiver arranged to communicate with one or more RFID tags over an RF communication channel. For example, the RFID transceiver may send a request for item information to an RFID tag over an RF communication channel, and the RFID tag may transmit item identification to the RFID transceiver over an RF communication channel. The embodiments are not limited in this context.

An RFID tag may be associated with, affixed to, embedded within, or form an integral part of one or more items. In various implementations, the RFID tag may be ultra high frequency (UHF), Microwave Frequency (μW), or high frequency (HF). The RFID tags may comprise active or passive RFID tags. An active RFID tag may comprise and derive energy from a battery. A passive RFID tag does not include a battery and may derive energy from a RF signal used to interrogate the RFID tag. The embodiments are not limited in this context.

In various implementations, an RFID tag may communicate item information to the RFID transceiver. The item information may comprise encoded numeric or alphanumeric data associated with a product. The data may be encoded according to a variety of code formats, such as according to the Electronic Product Code (EPC) protocol, for example. The item information may comprise, for example: an RFID code, a bar code, serial number, model number, part number, lot number, type, quantity, cost, price, manufacturer, supplier, distributor, buyer, manufacture date, shipping date, expiration date, service date, payment information, warranty period, security information, or other details. In various implementations, item information may be updated. The embodiments are not limited in this context.

In various implementations, the system 400 may be arranged to communicate one or more types of information, such as media information and control information. Media information generally may refer to any data representing content meant for a user, such as image information, video information, graphical information, audio information, voice information, textual information, numerical information, alphanumeric symbols, character symbols, and so forth. Control information generally may refer to any data representing commands, instructions or control words meant for an automated system. For example, control information may be used to route media information through a system, or instruct a node to process the media information in a certain manner. The media and control information may be communicated to and from a number of different devices or networks. The embodiments are not limited in this context.

In various implementations, the system 400 may communicate information according to one or more protocols. A protocol may comprise a set of predefined rules or instructions defined by one or more standards as promulgated by an organization, such as the Institute of Electrical and Electronics Engineers (IEEE), Internet Engineering Task Force (IETF), International Telecommunications Union (ITU), and so forth. For example, the system 400 may communicate information according to one or more IEEE 802 standards including IEEE 802.11x (e.g., 802.11a, b, g/h, j, n) standards for WLANs and/or 802.16 standards for WMANs. The system 400 also may communicate information according to one or more of the Digital Video Broadcasting Terrestrial (DVB-T) broadcasting standard and the High performance radio Local Area Network (HiperLAN) standard. The embodiments are not limited in this context.

In various implementations, the system 400 may comprise or form part of a network, such as a wireless personal area network (WPAN), a wireless local area network (WLAN), a wireless metropolitan are network (WMAN), a wireless wide area network (WWAN), a Code Division Multiple Access (CDMA) cellular radiotelephone communication network, a third generation (3G) network such as Wide-band CDMA (WCDMA), a fourth generation (4G) network, a Time Division Multiple Access (TDMA) network, an Extended-TDMA (E-TDMA) cellular radiotelephone network, a Global System for Mobile Communications (GSM) cellular radiotelephone network, a North American Digital Cellular (NADC) cellular radiotelephone network, a universal mobile telephone system (UMTS) network, a Local Area Network (LAN), a Metropolitan Area Network (MAN), a Wide Area Network (WAN), the Internet, the World Wide Web, a telephone network, a radio network, a television network, a cable network, a satellite network, and/or any other wired or wireless communications network configured to carry data. The embodiments are not limited in this context.

In various implementations, the system 400 may comprise a packet network for communicating information in accordance with one or more packet protocols as defined by one or more IEEE 802 standards, for example. In various embodiments, the system 400 may employ the Asynchronous Transfer Mode (ATM) protocol, the Physical Layer Convergence Protocol (PLCP), Frame Relay, Systems Network Architecture (SNA), and so forth. In another example, the system 400 may communicate packets using a medium access control protocol such as Carrier-Sense Multiple Access with Collision Detection (CSMA/CD), as defined by one or more IEEE 802 Ethernet standards. In yet another example, the system 400 may communicate packets in accordance with Internet protocols, such as the Transport Control Protocol (TCP) and Internet Protocol (IP), TCP/IP, X.25, Hypertext Transfer Protocol (HTTP), User Datagram Protocol (UDP), and so forth. The embodiments are not limited in this context.

In various implementations, the system 400 may be arranged to segment a set of media information and control information into a series of packets. A packet generally may comprise a discrete data set having fixed or varying lengths, and may be represented in terms of bits or bytes. A typical packet length, for example, might comprise 1000 bytes. Each packet may contain a portion of the media information plus some control information and have a sequence number. The control information may assist routing each packet to an intended destination. A destination node may receive the entire set of packets, place them in the correct order using the sequence numbers, and reproduce the media information. It can be appreciated that the described embodiments are applicable to any type of communication content or format, such as packets, cells, frames, fragments, units, and so forth. The embodiments are not limited in this context.

In various implementations, system 400 may communicate information over wired communications media. Examples of wired communications media may include a wire, cable, printed circuit board (PCB), backplane, switch fabric, semiconductor material, twisted-pair wire, co-axial cable, fiber optics, and so forth. In various embodiments, communications media may be connected to a node using an input/output (I/O) adapter. The I/O adapter may be arranged to operate with any suitable technique for controlling information signals between nodes using a desired set of communications protocols, services or operating procedures. The I/O adapter may also include the appropriate physical connectors to connect the I/O adapter with a corresponding communications medium. Examples of an I/O adapter may include a network interface, a network interface card (NIC), disc controller, video controller, audio controller, and so forth. The embodiments are not limited in this context.

Operations for the above systems, nodes, apparatus, elements, and/or sub-systems may be further described with reference to the following figures and accompanying examples. Some of the figures may include programming logic. Although such figures presented herein may include a particular programming logic, it can be appreciated that the programming logic merely provides an example of how the general functionality as described herein can be implemented. Further, the given programming logic does not necessarily have to be executed in the order presented unless otherwise indicated. In addition, the given programming logic may be implemented by a hardware element, a software element executed by a processor, or any combination thereof. The embodiments are not limited in this context.

Figure 5:
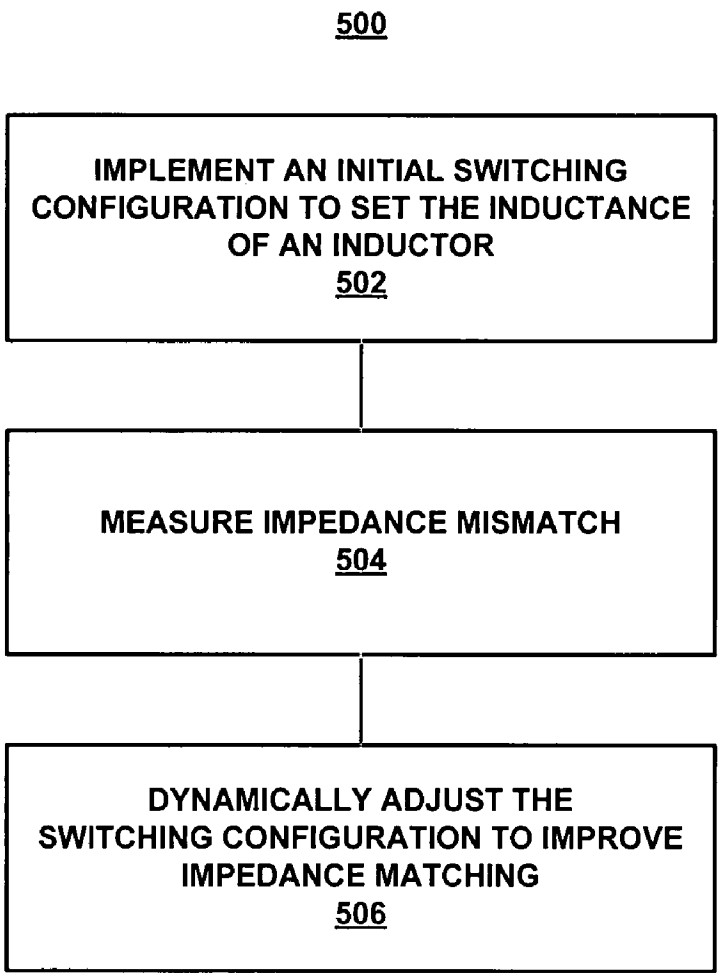
FIG. 5 illustrates one embodiment of a logic flow.

FIG. 5 illustrates one embodiment of a logic flow. FIG. 5 illustrates logic flow 500 for performing impedance matching. The logic flow 500 may be performed by a node and/or a system, for example. It is to be understood that the logic flow 500 may be implemented by various other types of hardware, software, and/or combination thereof. The embodiments are not limited in this context.

In various embodiments, the logic flow 500 may comprise a closed loop algorithm to automatically tune the impedance of an inductor. The logic flow 500 may comprise implementing an initial switching configuration to set the inductance of an inductor (block 502), measuring the impedance mismatch (block 504), and dynamically adjusting the switching configuration to improve impedance matching (block 506). In various implementations, implementing and adjusting the switching configuration may involve using a switching mechanism to vary the inductance of the inductor and using a disconnect mechanism to reduce the parasitic effects of the inductor. Impedance mismatch may be based on the received power of a receiver and/or the insertion loss of a transmitter. By dynamically adjusting the switching configuration in quick succession, impedance matching may be improved by maximizing radiated energy. The embodiments are not limited in this context.

Figure 6:
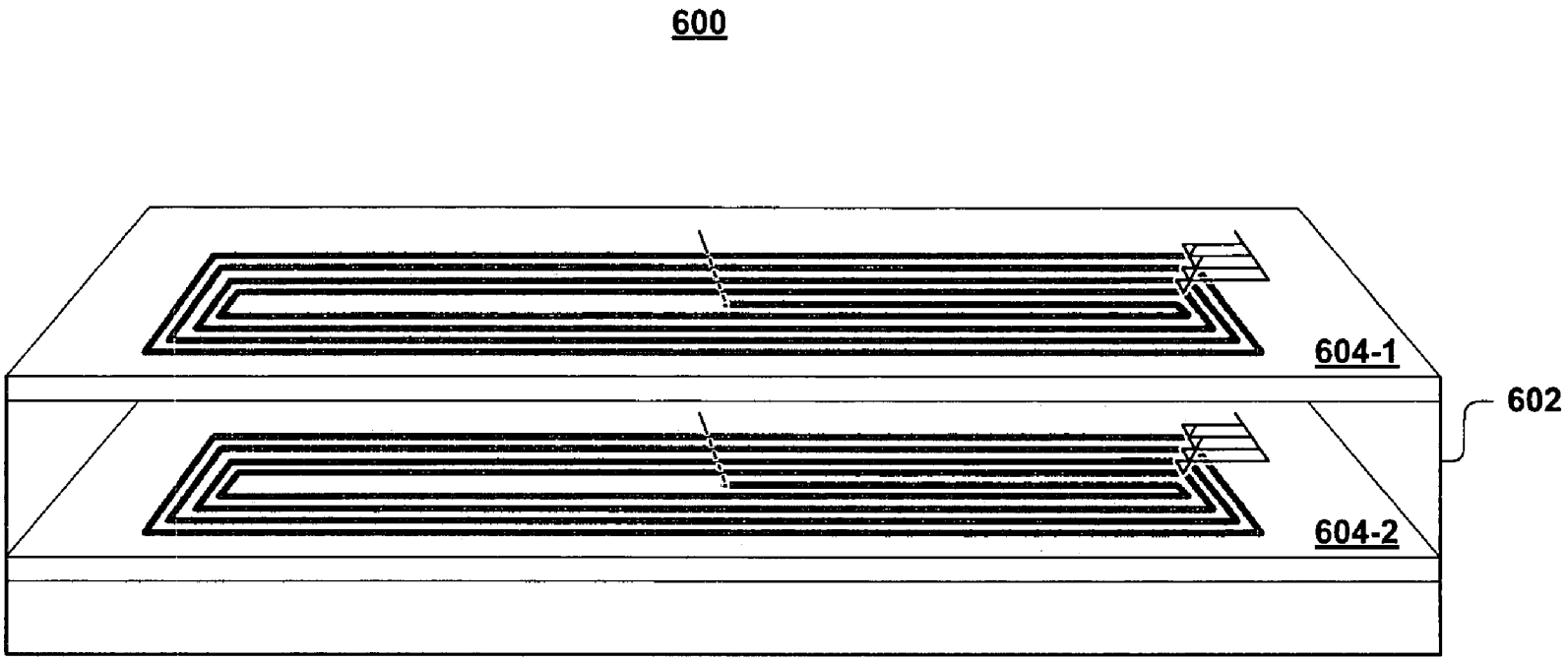
FIG. 6 illustrates one embodiment of a node.

FIG. 6 illustrates one embodiment of a node. FIG. 6 illustrates a transformer node 600. The transformer node 600 may comprise a substrate 602 having several layers. In various embodiments, the transformer node 600 may comprise a first tunable inductor 604-1 coupled to second tunable inductor 604-2. Each of the tunable inductors may be implemented by MEMS node 100 or MEMS node 200, for example. The transformer node 600 may be implemented in a node of system 400, for example. The embodiments are not limited in this context.

In various implementations, the transformer node 600 may be tuned by varying the turn ratio of the first inductor 604-1 to the second inductor 604-2 by varying the inductance of the first inductor 604-1 and the second inductor 604-2. The embodiments are not limited in this context.

In various implementations, the described embodiments may increase the performance of a poorly matched RF system by adaptively correcting for the mismatch with a low loss matching network and by reducing reflected RF energy. For example, the described embodiments may improve the dynamic range of a receiver by reducing reflected RF energy from impedance mismatch by dynamically tuning the RF port impedance automatically. The described embodiments may protect sensitive RF circuitry from RF energy reflected due to impedance mismatch.

In various implementations, the described embodiments may used in RFID readers and in high power cellular and network transmitters. In systems in which an antenna is subjected to interference such as from metal passing through its field and causing its impedance to change, the described embodiments may continuously optimize matching to maximize radiated energy. When scaled to the appropriate frequency ranges, the described embodiments may be used in intermediate frequency (IF), baseband, and audio frequency applications.

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

Some embodiments may be implemented, for example, using a machine-readable medium or article which may store an instruction or a set of instructions that, if executed by a machine, may cause the machine to perform a method and/or operations in accordance with the embodiments.

Such a machine may include, for example, any suitable processing platform, computing platform, computing device, processing device, computing system, processing system, computer, processor, or the like, and may be implemented using any suitable combination of hardware and/or software. The machine-readable medium or article may include, for example, any suitable type of memory unit, memory device, memory article, memory medium, storage device, storage article, storage medium and/or storage unit, for example, memory, removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD), a tape, a cassette, or the like. The instructions may include any suitable type of code, such as source code, compiled code, interpreted code, executable code, static code, dynamic code, and the like. The instructions may be implemented using any suitable high-level, low-level, object-oriented, visual, compiled and/or interpreted programming language, such as C, C++, Java, BASIC, Perl, Matlab, Pascal, Visual BASIC, assembly language, machine code, and so forth. The embodiments are not limited in this context.

Some embodiments may be implemented using an architecture that may vary in accordance with any number of factors, such as desired computational rate, power levels, heat tolerances, processing cycle budget, input data rates, output data rates, memory resources, data bus speeds and other performance constraints. For example, an embodiment may be implemented using software executed by a general-purpose or special-purpose processor. In another example, an embodiment may be implemented as dedicated hardware, such as a circuit, an ASIC, PLD, DSP, and so forth. In yet another example, an embodiment may be implemented by any combination of programmed general-purpose computer components and custom hardware components. The embodiments are not limited in this context.

Unless specifically stated otherwise, it may be appreciated that terms such as "processing," "computing," "calculating," "determining," or the like, refer to the action and/or processes of a computer or computing system, or similar electronic computing device, that manipulates and/or transforms data represented as physical quantities (e.g., electronic) within the computing system's registers and/or memories into other data similarly represented as physical quantities within the computing system's memories, registers or other such information storage, transmission or display devices. The embodiments are not limited in this context.

It is also worthy to note that any reference to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

While certain features of the embodiments have been illustrated as described herein, many modifications, substitutions, changes and equivalents will now occur to those skilled in the art. It is therefore to be understood that the appended claims are intended to cover all such modifications and changes as fall within the true spirit of the embodiments.

The invention claimed is:

1. An apparatus, comprising:

an inductor formed on a substrate;

a switching mechanism contacting the inductor to vary inductance of said inductor, said switching mechanism comprising one or more microelectromechanical switch armatures; and a disconnect mechanism contacting the inductor to reduce parasitic effects of the inductor upon actuation of said switching mechanism.

2. The apparatus of claim 1, wherein said inductor is formed on a single layer of said substrate.

3. The apparatus of claim 1, wherein said inductor is formed on multiple layers of said substrate.

4. The apparatus of claim 1, wherein said microelectromechanical switch armatures comprise one or more cantilever-type switches.

5. The apparatus of claim 1, wherein said disconnect mechanism comprises one or more microelectromechanical switches.

6. The apparatus of claim 1 comprising a first inductor formed on a first layer of said substrate and a second inductor formed on a second layer of said substrate.

7. A system, comprising:

an antenna;

a microelectromechanical node to couple to said antenna, said microelectromechanical node comprising:

an inductor formed on a substrate;

a switching mechanism contacting the inductor to vary inductance of said inductor; and a disconnect mechanism contacting the inductor to reduce parasitic effects of the inductor upon actuation of said switching mechanism.

8. The system of claim 7, wherein said inductor is formed on a single layer of said substrate.

9. The system of claim 7, wherein said inductor is formed on multiple layers of said substrate.

10. The system of claim 7, wherein said switching mechanism comprises one or more microelectromechanical switch armatures.

11. The system of claim 10, wherein said microelectromechanical switch armatures comprise one or more cantilever-type switches.

12. The system of claim 7, wherein said disconnect mechanism comprises one or more microelectromechanical switches.

13. The system of claim 7 comprising a first inductor formed on a first layer of said substrate and a second inductor formed on a second layer of said substrate.

14. The system of claim 7, wherein said microelectromechanical node forms part of an impedance matching system including.

15. The system of claim 7, wherein said microelectromechanical node forms part of a radio frequency identification transceiver.

* * * * *